United States Patent [19]

Folk

[11] Patent Number: 4,567,797

[45] Date of Patent: Feb. 4, 1986

[54] ULTRASONIC CUTTING APPARATUS AND METHODS

[76] Inventor: Donald C. Folk, 10415 Folsom Blvd. #106, Rancho Cordova, Calif. 95670

[21] Appl. No.: 574,978

[22] Filed: Jan. 30, 1984

[51] Int. Cl.[4] ..... B26D 7/08

[52] U.S. Cl. ..... 83/56; 83/13; 83/427; 83/433; 83/701

[58] Field of Search ..... 83/13, 56, 701, 433, 83/427, 425, 858, 856; 30/272 R, 272 A; 128/305, 24 A; 318/116, 118; 310/26; 51/59 SS

[56] References Cited

U.S. PATENT DOCUMENTS

| | | | |
|---|---|---|---|
| Re. 28,752 | 3/1976 | Balamuth et al. | 128/24 A |
| 3,086,288 | 4/1963 | Balamuth et al. | 30/272 R |
| 3,357,290 | 12/1967 | Neale | 83/701 X |
| 3,774,317 | 11/1973 | Balamuth et al. | 310/26 X |
| 3,817,141 | 6/1974 | Simonetti | 51/59 SS |
| 3,974,728 | 8/1976 | Herlan | 83/698 X |
| 3,990,452 | 11/1976 | Murry | 128/305 |
| 4,343,111 | 8/1982 | Inoue | 51/59 SS |

OTHER PUBLICATIONS

Chapulin Ultrasonic Drill Brochure

*Primary Examiner*—James M. Meister
*Attorney, Agent, or Firm*—William P. Green

[57] ABSTRACT

A precisely controllable cut is made in a workpiece by ultrasonic equipment including a horn or other element which is vibrated at ultrasonic frequency along a predetermined axis, and which carries a cutter mounted for vibration with the horn along the axis, with the cutter having a leading cutting edge disposed at an angle of between about 30 degrees and 40 degrees (preferably between about 33 degrees and 37 degrees), with respect to the specified axis of vibration. The cutting edge should desirably be disposed approximately perpendicularly with respect to the surface of the workpiece as the cut is made, the preferred angle with respect thereto being between about 85 degrees and 105 degrees.

10 Claims, 5 Drawing Figures

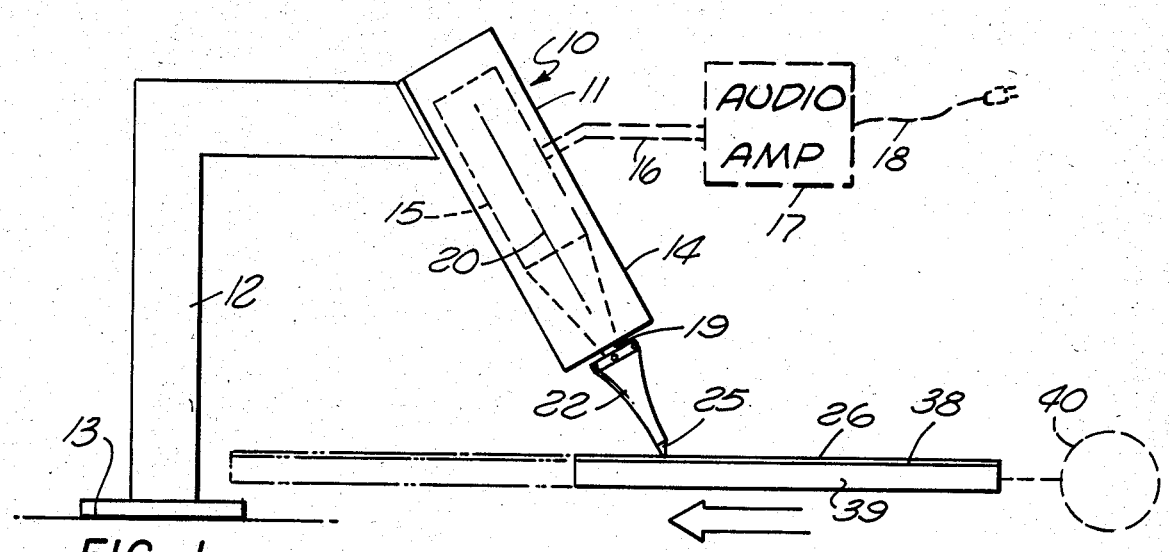
FIG. 1
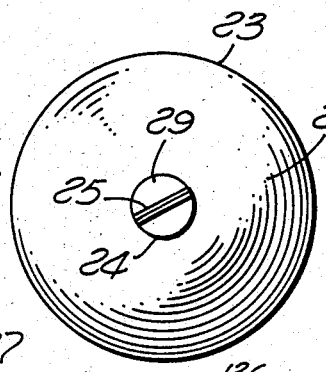
FIG. 5
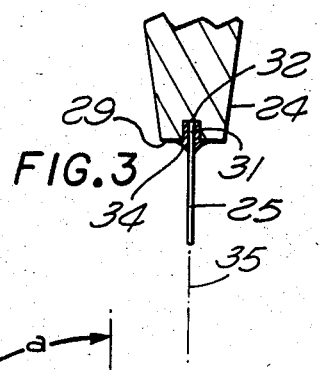
FIG. 3
FIG. 6
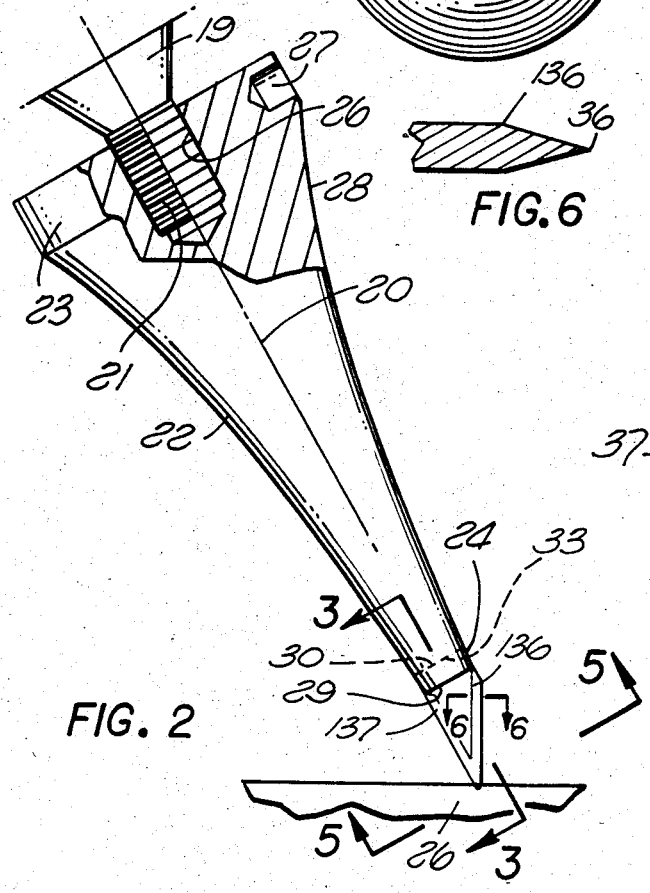
FIG. 2
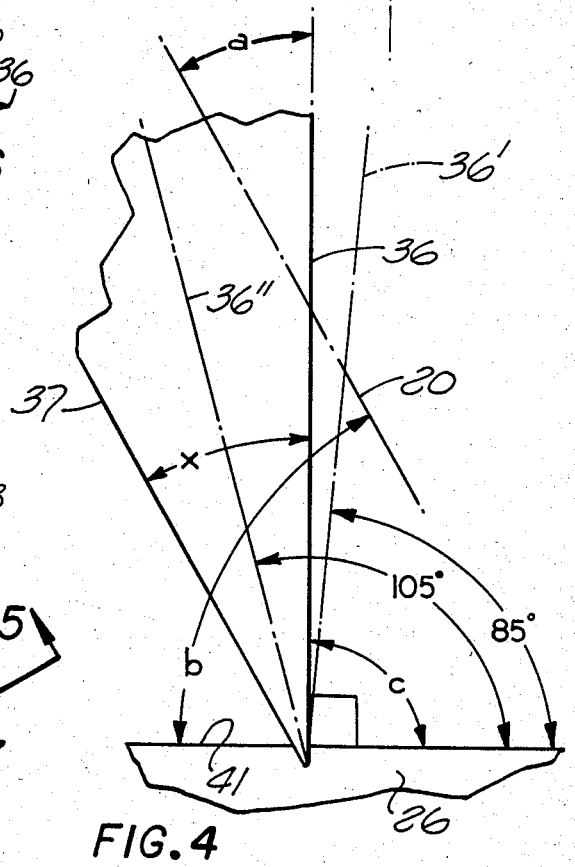
FIG. 4

ULTRASONIC CUTTING APPARATUS AND METHODS

BACKGROUND OF THE INVENTION

This invention relates to improved apparatus and methods for forming a cut ultrasonically in a workpiece.

The invention has been developed primarily to provide a way of cutting materials which cannot be easily or effectively cut utilizing conventional equipment and methods. One such material is that sold under the trademark "Kevlar" by E.I. DuPont de Nemours, which product includes fibers of a tough resinous plastic material embedded within a resin, and which product is asserted to have a strength to weight ratio greater than any other known material. Attempts have been made to cut this material with conventional saw blades and other standard cutting tools, but with only very limited success by reason of the tendency of these blades and tools to produce a very rough gouging type of action, tearing the material apart and leaving frayed and irregular edges at both sides of the cut.

Ultrasonic equipment has been proposed in the past for machining or cutting metals and materials, but in the forms previously devised this equipment has not to my knowledge been successful in cutting KEVLAR. Such ultrasonic apparatus includes a vibration amplifying horn or other element which is vibrated along a predetermined axis by electronically energized circuitry, and which carries a cutter vibrating with the horn for producing a cut in the workpiece.

SUMMARY OF THE INVENTION

The present invention provides improved equipment and methods capable of making a cut in KEVLAR and various other types of difficult-to-machine material very rapidly and without fraying, burning, or otherwise adversely affecting the edges of the material at the cut, and with those edges being left in smooth, straight condition after the cutting operation. Further, the cut can be made at very low cost, and with little or no wear on the cutter or other equipment utilized, to thus enable many cuts to be made over an extended period of time before any type of repair or reconditioning of the cutting equipment becomes necessary.

To obtain these results, the invention utilizes ultrasonic equipment in which the cutter, and particularly the leading edge of the cutter, have a unique orientation with respect to the vibratory axis of the ultrasonic head. More particularly, it is found that an optimum cutting effect can be achieved by forming and positioning the leading cutting edge of the cutter to be disposed at an angle of between about 30 degrees and 40 degrees with respect to the axis along which the cutter is vibrated. Best results are achieved when this angular relation is between about 33 degrees and 37 degrees, desirably about 35 degrees.

The effectiveness of the cut is further enhanced by positioning the leading edge of the cutter to be disposed approximately perpendicular to, preferably between about 85 degrees and 105 degrees with respect to, a surface of the work-piece being cut.

BRIEF DESCRIPTION OF THE DRAWING

The above and other features and objects of the invention will be better understood from the following detailed description of the typical embodiment illustrated in the accompanying drawings, in which:

FIG. 1 is a partially diagrammatic representation of an ultrasonic cutting system embodying the invention;

FIG. 2 is an enlarged side elevational view, partially in section, of the amplifying horn and cutter of FIG. 1;

FIG. 3 is a fragmentary axial section taken on line 3—3 of FIG. 2;

FIG. 4 is an enlargement of the cutter of FIG. 2, illustrating the relationship between its cutting edge and vibratory axis and the surface of the work part; and FIG. 5 is a view taken on line 5—5 of FIG. 2.

FIG. 6 is an enlarged fragmentary section taken along line 6—6 of FIG. 2.

DETAILED DESCRIPTION OF THE TYPICAL EMBODIMENT OF THE INVENTION

In FIG. 1, there is represented at 10 an ultrasonic generator, having a body 11 supported on a stand 12 which may rest on or be secured to a horizontal base 13. Body 11 may include a housing 14 containing a conventional ultrasonic transducer 15 preferably of the piezoelectric type. Transducer 15 is energized electrically by high frequency alternating current supplied through lines 16 from an audio amplifier 17 which may receive power through a cord or other supply represented at 18. The frequency of the alternating current in lines 16 from audio amplifier 17 is preferably within the ultrasonic range, say between about 20,000 and 30,000 cycles per second, preferably about 25,000 cycles per second. The transducer 15 converts this alternating electrical energy to a mechanical vibratory motion at the same frequency, causing an output element 19 of the transducer to vibrate at ultrasonic frequency (typically 25,000 cycles per second as mentioned) along a predetermined axis 20 of the transducer. The output element 19 may have threads 21 centered about the vibratory axis 20 for connection to a mechanical amplifying horn 22 to be driven by the transducer.

Horn 22 preferably has the shape illustrated in FIGS. 2, 3 and 5, being centered about the vibratory axis 20 of transducer 15, to be vibrated or oscillated mechanically along that axis by the vibrating element 19 to which it is attached. Horn 22 tapers progressively from a large diameter end 23 at which it is attached to element 19 to a small diameter end 24 at which it rigidly carries a cutter 25 for cutting a workpiece 26.

The large diameter end 23 of horn 22 may be circular about axis 20, and contain a threaded bore 26 into which the externally threaded part 19 is connected to attach the horn rigidly to part 19 for powered vibration therewith. A number of circularly spaced recesses 27 may be formed in the periphery of the large diameter end portion 23 of the horn, for engagement by a spanner wrench or other tool in connecting the horn to part 19. As the outer surface 28 of horn 22 decreases progressively in diameter in extending from large diameter end 23 of the horn to its small diameter end 24, the surface 28 is at all points circular about axis 20.

At its smaller end 24, the horn 22 may have a transverse end surface 29 perpendicular to axis 20, with a slot 30 being formed in that reduced diameter end 24 for reception of an upper mounting portion 31 of cutter 25. Slot 30 lies essentially in a plane 35 which contains axis 20 and extends diametrically with respect thereto and across end portion 24 of the horn. The upper portion of the cutter has an upper edge 32 extending diametrically of axis 20 and received adjacent a diametrical upper inner wall 33 of the slot. The cutter is securely retained in the illustrated position relative to horn 22 by a fusion bonding material 34, desirably silver solder The cutter 25 is essentially flat or planar, and is mounted to lie essentially within the previously mentioned plane 35 containing axis 20. The cutter has a leading edge 36 which performs the actual cutting operation on workpiece 26, and has a trailing edge 37 disposed at an angle x with respect to leading edge 36. Edge 36 is preferably essentially straight, and is disposed at an angle a with respect to the vibratory axis 20 of the device. Trailing edge 37 may be disposed essentially parallel to axis 20.

The angle a between leading edge 36 of the cutter and the vibratory axis 20 along which horn 22 and cutter 25 vibrate is preferably between about 30 degrees and 40 degrees, and more specifically should in most instances be between about 33 degrees and 37 degrees, for best results about 35 degrees.

The workpiece 26 may take the form of a sheet of Kevlar or other material to be cut, extending horizontally on an upper horizontal surface 38 of a holder or support member 39. This member 39 and the carried workpiece 26 are maintained in horizontal position and shifted horizontally in a right to left direction as viewed in FIG. 1, by a powered drive unit diagrammatically represented at 40 in FIG. 1, or by hand. The workpiece may thus be shifted leftwardly relative to the cutter 25, with the latter being held in a fixed position by stand 12. Alternatively, the ultrasonic unit 10 and cutter 25 may be power actuated to the right in FIG. 1 while the support 39 and horizontally extending workpiece 26 are maintained in fixed position. In either event, the vibratory axis 20 along which cutter 25 is vibrated is continuously maintained at a predetermined angle b with respect to the horizontal surface 41 of the material 26 to be cut. That angle b is desirably such as to continuously maintain the cutting or leading edge 36 of cutter 25 at a predetermined angle c with respect to the exposed surface 41 of the work material 26. As seen FIG. 4, edge 36 is preferably approximately perpendicular to the planar surface 41 of the work material. This relationship may vary slightly from a truly perpendicular condition, with the angle c between edge 36 and the portion of surface 41 ahead of edge 36 (to the right of edge 36 in FIG. 4) desirably being between about 85 degrees and 105 degrees. The broken line 36' in FIG. 4 represents the position of cutting edge 36 when the angularity between the cutting edge and the portion of surface 41 to the right of it is 85 degrees, while the broken line 36" represents the position of cutting edge 36 when that angularity is 105 degrees.

In the presently preferred arrangement, horn 22 is formed of monel metal, and the cutter blade 25 is formed of 17-4 stainless steel. It is contemplated, however, that the blade may also be formed of other appropriate materials, such as R-monel metal.

The cutter is preferably hardened by heat treatment before attachment to the horn, and is then silver soldered or otherwise fuse bonded to the horn in a manner avoiding destruction of the heat treated condition. More particularly the cutter may first be heat treated at a predetermined temperature for a specified period of time, such as one hour, after which it is cooled and the fused bond joint is then formed between the cutter and horn by again heating the parts and silver solder or other fuse bonding material to an elevated temperature high enough to form the connection effectively but not substantially above the temperature at which the cutter was heat treated. In a preferred process, in which the cutter is formed of 17-4 stainless steel, the cutter is first heat treated at a temperature between about 1150 degrees F. and 1250 degrees F., preferably 1200 degrees F., after which the cutter is attached rigidly to the horn by melting silver solder at a temperature between about 1150 degrees F. and 1200 degrees F., preferably the latter. The silver solder utilized for this purpose and having a melting point in the specified range may consist of 80% copper, 15% silver and 5% phosphorus.

As seen in FIG. 6, the leading edge 36 of the cutter is preferably sharpened, to progressively decrease in thickness between a location 136 and the edge 36. The leading edge portion may have this same sharpened cross section along the entire length of edge 36. The trailing edge 37 may have a similar sharpened cross section along its entire length to decrease progressively in thickness between a location 137 and edge 37.

In making a cut in a workpiece of Kevlar as represented at 26 in FIG. 1, the workpiece and its support 39 may be moved to the left as discussed relative to cutter 25 while the cutter and horn 22 are vibrated along axis 20 at ultrasonic frequency (say 25,000 c.p.s.), and while the cutter and horn are maintained in the predetermined angular orientation discussed above with respect to the workpiece. During the leftward movement of the workpiece, the cutter is held in a position in which the plane 35 of the cutter extends parallel to the direction of movement of the workpiece.

With the angularities and positioning of the cutter as discussed, edge 36 of the cutter functions to form a very effective and smooth cut in the sheet of Kevlar, with no fraying of the material at the opposite sides of the cut and no burning or other degradation of the material in any way. If the angle a between the cutting edge and the axis 20 of vibration of the parts is varied beyond the discussed limits, the work material tends to fray or the bonding resin of the Kevlar burns or liquifies. Also, if the angle c is varied beyond the described limits, the resulting cut is not as effective and smooth as is desired.

In addition to Kevlar, the apparatus as described has proven very effective for the cutting of other materials, such as for example cardboard, gum rubber, nylon, polypropylene, fiberglass and various other substances.

If the cutter is attached to the horn by means other than a fusion bond, such as by a pin, screw, bolt, threaded connection, or other mechanical type connection, the ultrasonic vibration of the parts may rapidly destroy the connection of the cutter to the horn and quickly render the apparatus ineffective for its intended purpose.

It may be noted that in the actual operation of the device, the cutting edge 36 may not actually cut the workpiece by direct contact therewith, but rather may produce the cut indirectly by discharging grit against the work material as the cutter vibrates.

While a certain specific embodiment of the present invention has been disclosed as typical, the invention is of course not limited to this particular form, but rather is applicable broadly to all such variations as fall within the scope of the appended claims.

I claim:

1. Apparatus comprising:

an ultrasonic generator including a vibratory element and means for vibrating said element along an axis at ultrasonic frequency;

a cutter connected to said element for vibration therewith along said axis and having a leading edge with a cutting portion disposed at an angle of between about 33° and 37° with respect to said axis of vibratory movement;

means for supporting said ultrasonic generator and a workpiece in sheet form in a predetermined relative angular orientation in which said axis of vibration is disposed at a predetermined oblique angle to a surface of said sheet form workpiece, and said cutting portion of the leading edge which is disposed at said angle of between about 33 and 37 degrees to said axis is positioned to cut the workpiece and is disposed at an angle of between about 85 and 105 degrees to said surface of the workpiece;

said supporting means being constructed to move said generator and supported workpiece relative to one another in a predetermined direction essentially parallel to said surface of the workpiece in a relation causing said leading edge to make a cut in the workpiece, while maintaining said axis of vibration at said oblique angle to said surface and maintaining said cutting portion of the leading edge at said angle between about 85 and 105 degrees to said surface of the workpiece.

2. Apparatus as recited in claim 1, in which said leading edge of the cutter is disposed at an angle of about 35° with respect to said vibratory axis.

3. Apparatus as recited in claim 1, in which the cutter is attached to said element by a fusion bond.

4. Apparatus as recited in claim 1, in which the cutter is connected rigidly to said vibratory element by a fusion bond formed of a material having a melting point between about 1,150 degrees F. and 1,200 degrees F.

5. Apparatus as recited in claim 1, in which said cutter is heat treated and is attached rigidly to said element by a fusion bond formed of a material having a melting point lower than the heat treat temperature of the cutter.

6. Apparatus as recited in claim 5, in which said vibratory element is a vibration amplifying horn which has a large diameter end connected to and driven by said mentioned means and which tapers progressively to a small diameter end to which said cutter is connected.

7. Apparatus as rectied in claim 1, in which said vibratory element is a horn which has a large diameter end connected to and driven by said mentioned means and which tapers progressively to a small diameter end to which said cutter is connected.

8. Apparatus as recited in claim 7, in which said small diameter end of the horn contains a slot extending diametrically of said axis and within which a portion of said cutter is received, said cutter being attached rigidly to said horn within said slot by a fusion bond.

9. Apparatus as recited in claim 1, in which said cutter is heat treated at a temperature of between about 1,150 degrees F. and 1,250 degrees F., and said cutter is secured rigidly to said element by a fusion bond formed of a material having a melting temperature between about 1,150 degrees F. and 1,200 degrees F.

10. The method that comprises:

vibrating along a predetermined axis a cutter having a leading edge disposed at an angle of between about 33 and 37 degrees with respect to said vibratory axis;

moving said cutter and a workpiece in sheet form relative to one another in a predetermined direction essentially parallel to a surface of the workpiece and in a relation causing said leading edge of the cutter to make a cut in the workpiece;

maintaining said axis of vibration of the cutter at a predetermined oblique angle to said surface of the workpiece as the cut is made; and maintaining the portion of said leading edge which makes said cut at an angle of between about 85 and 105 degrees to said surface of the workpiece as the cut is made.

* * * * *